US005487694A

United States Patent [19]

Deming

[11] Patent Number: 5,487,694

[45] Date of Patent: Jan. 30, 1996

[54] METHOD FOR SHAPING HONEYCOMB SUBSTRATES

[75] Inventor: Scott W. Deming, Elmira, N.Y.

[73] Assignee: Corning Incorporated, Corning, N.Y.

[21] Appl. No.: 151,107

[22] Filed: Nov. 12, 1993

[51] Int. Cl.[6] ..... B24B 19/08

[52] U.S. Cl. ..... 451/49; 409/132; 409/199; 451/913

[58] Field of Search ..... 451/5, 11, 28, 451/49, 424, 913; 409/132, 199, 198

[56] References Cited

U.S. PATENT DOCUMENTS

| | | | |
|---|---|---|---|
| 2,087,874 | 7/1937 | Indge | 451/49 |
| 2,224,423 | 12/1940 | Binns | 451/49 |
| 2,327,608 | 8/1943 | Saltz | 451/49 |
| 3,112,184 | 11/1963 | Hollenbach . | |
| 3,790,654 | 2/1974 | Bagley . | |
| 4,054,081 | 10/1977 | Brown | 409/132 |
| 4,199,387 | 4/1980 | Hladik . | |
| 4,329,162 | 5/1982 | Pitcher . | |
| 4,417,908 | 11/1983 | Pitcher . | |

FOREIGN PATENT DOCUMENTS 2449593 6/1975 Germany .

*Primary Examiner*—Jack W. Lavinder
*Attorney, Agent, or Firm*—Timothy M. Schaeberle

[57] ABSTRACT

Disclosed herein is a method for producing a honeycomb body having a side surface bounded by a closed cylinder of a selected circumference and curvature comprising the steps of providing an extruded honeycomb body having a selected length and having a side surface bounded by a closed cylinder of a circumference larger than the selected and desired circumference; and removing material from the side surface to reduce the circumference thereof at least to the selected circumference. The instant invention's step of removing material from the side surface comprises grinding the side surface with a rotating abrasive means having a length at least equal to the selected length and an axis of rotation parallel to the side surface. Furthermore, the rotating abrasive means is attached to a spindle means which allows and controls movement of the rotating abrasive means in a plane perpendicular to the axis of rotation.

5 Claims, 1 Drawing Sheet

FIG. 1
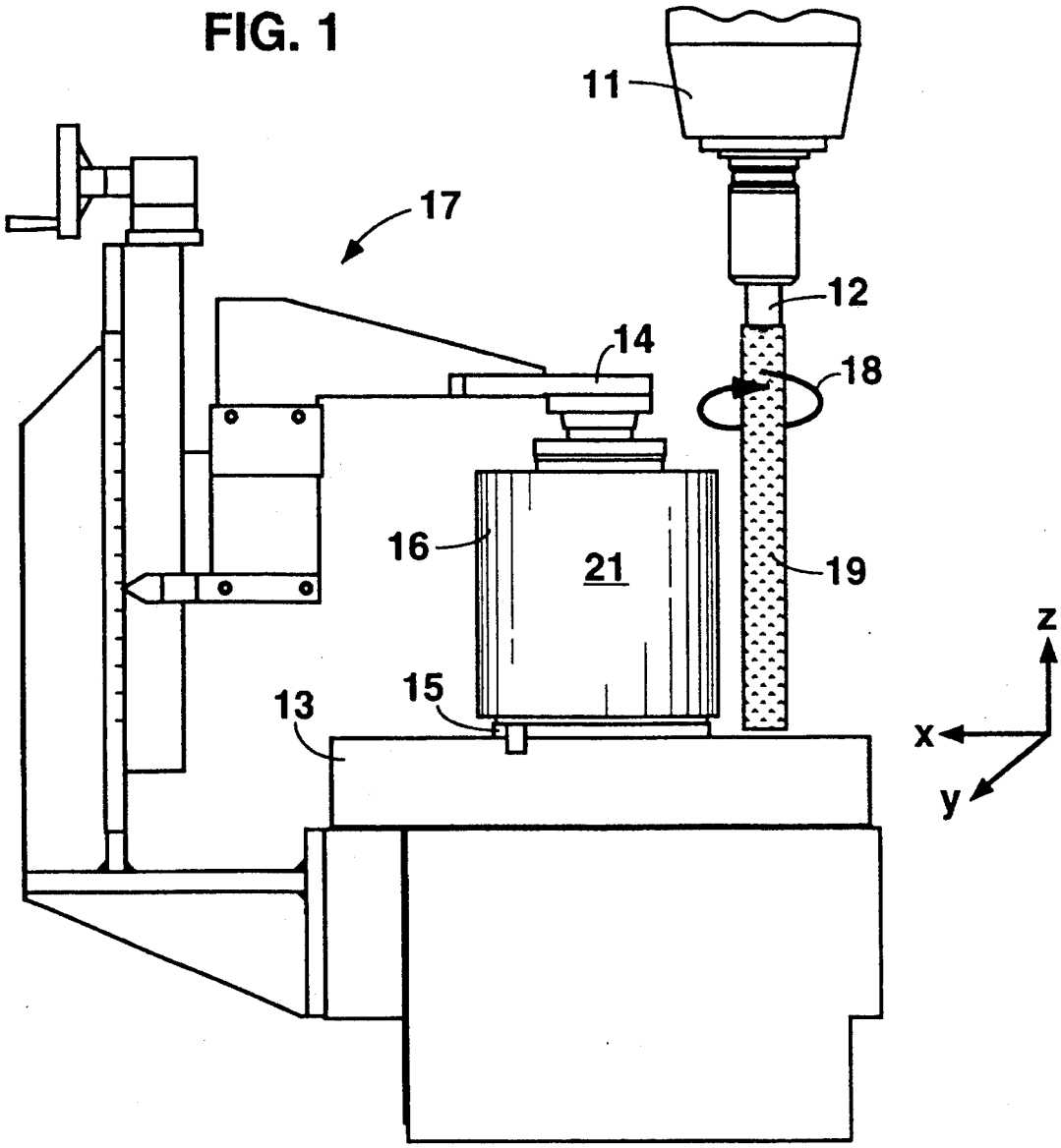
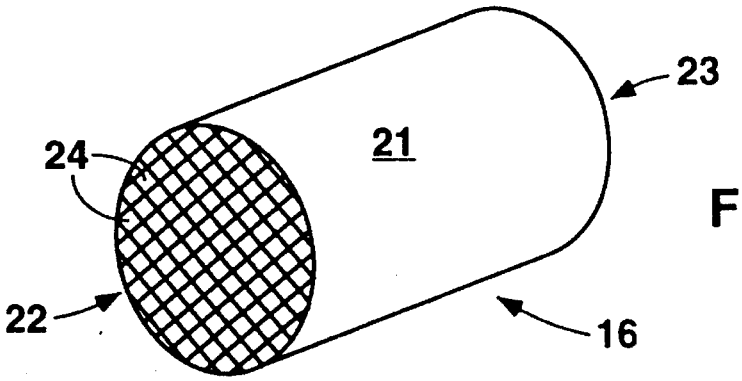
FIG. 2

METHOD FOR SHAPING HONEYCOMB SUBSTRATES

FIELD OF THE INVENTION

The present invention relates to a method and apparatus for shaping and finishing inorganic honeycomb substrates, to provide finished substrates of preselected shape and/or dimensions for packaging or other finishing operations.

BACKGROUND OF THE INVENTION

Inorganic honeycomb manufacture is known, for example, from U.S. Pat. Nos. 3,122,184 (Hollenbach) and 3,790,654 (Bagley). Also known are procedures for the application of surfacing or plugging materials to such honeycombs, for purposes such as the sealing or selective blocking of surface pores or channels in the honeycomb structure to obtain a desired fluid flow pattern therein. U.S. Pat. No. 4,199,387, for example, describes a sealing method wherein a cement is spread on the outside surface of a honeycomb body.

Currently in large-scale commercial use is the extrusion of ceramic and metal honeycombs for fluid heating, catalytic treating, and/or fluid filtration applications. Examples of products produced by these methods are porous ceramic honeycomb bodies specially adapted for use as exhaust gas filters in diesel engine exhaust systems (referred to as DPF's). U.S. Pat. Nos. 4,417,908 (Pitcher) and 4,329,162 (Pitcher) disclose examples of these DPF products.

In one approach to the manufacture of honeycomb substrates for fluid filtration applications, substrate honeycombs of oversize dimensions are first extruded from batches of particulate ceramic or metal material, and then reshaped after drying to a size and shape appropriate for their intended use. This resizing, also termed contouring, is used to prepare the substrates for the application of surfacing or skin layers of ceramic material, by finalizing the shape and/or dimensions of the extruded body as needed for encasing or "canning" the body in a suitable durable container for later use.

Oversize extrusion followed by contouring can be economically attractive, since by that means a variety of honeycomb products of a selected cell size, shape and density can be produced from the extruder output of a single extrusion production line. However, such production is presently disadvantaged to the extent that contouring must be carried out by band-sawing and or wet-sanding of the dried extruded honeycomb shapes. Sawing is not economical because of problems relating to low blade life, and in addition has had application to the production of substrates of round cross-section only. Sanding is disadvantageous because it is time consuming and labor intensive, requires a post-drying operation, and produces inconsistent results.

It is therefore an object of the present invention to provide a new contouring process applicable to the production of inorganic honeycomb substrates for a variety of applications.

It is a further object of the invention to provide a process for honeycomb substrate manufacture which produces a more uniform product at lower cost and in a shorter time.

It is a further object of the invention to provide apparatus for the contouring of extruded honeycomb substrates which provides rapid contouring of both dried and fired ceramic honeycomb bodies on a consistent and repeatable basis.

Other objects and advantages of the invention will become apparent from the following description thereof.

SUMMARY OF THE INVENTION

Hence, this invention is directed at a method for producing a honeycomb body having a side surface bounded by a closed cylinder of a selected circumference and curvature comprising the steps of providing an extruded honeycomb body having a selected length and having a side surface bounded by a closed cylinder of a circumference larger than the selected and desired circumference; and removing material from the side surface to reduce the circumference thereof at least to the selected circumference. The instant invention's step of removing material from the side surface comprises grinding the side surface with a rotating abrasive means having a length at least equal to the selected length and an axis of rotation parallel to the side surface. Furthermore, the rotating abrasive means is attached to a spindle means which allows and controls movement of the rotating abrasive means in a plane perpendicular to the axis of rotation.

BRIEF DESCRIPTION OF THE DRAWING

FIG. 1 is a diagrammatic front view of the apparatus for carrying out the inventive process for contouring or shaping the extruded honeycomb body.

FIG. 2 is a oblique view of a typical extruded honeycomb body prior to contouring by the inventive process.

DETAILED DESCRIPTION OF THE INVENTION

Referring now to FIG. 1, there is an apparatus setup shown, for carrying out the inventive shaping or contouring process, wherein an extruded honeycomb substrate body 16 is secured to support means 13, capable of rotation, by clamping means 17 comprised of vertically opposed clamps 14, 15. Rotating abrasive means 12 for shaping or contouring the substrate body 16 is attached to spindle means 11 for allowing and controlling the movement of rotating abrasive means 12 relative to substrate body 16. As shown in the FIGURE, rotating abrasive means 12 is capable of movement in at least the x and y directions, relative to substrate body 16, through movement of spindle means 11.

FIG. 2 depicts extruded honeycomb substrate body 16 which possesses a selected length and side surface 21 bounded by a closed cylinder of a circumference larger than the pre-selected desired circumference. In addition, substrate body 16 has opposing end surfaces 22,23 transverse to each of the side surface and honeycomb channels 24 traversing the body.

The method for producing the honeycomb body of a selected circumference and curvature comprises the steps of providing the extruded honeycomb body 16 and abrasively removing material from side surface 21 of the substrate body 16 to reduce the circumference thereof at least to a preselected desired circumference. Abrasively removing of the material from side surface 21 is accomplished through vertical-spindle-grinding of side surface 21 by rotating abrasive means 12 having a length at least equal to the length of side surface 21 and an axis of rotation 18 parallel to side surface 21. Rotating abrasive means 12 is a cylindrical member comprised of a surface coating 19 in which the material of the coating is an abrasive material selected from the group consisting of diamond, silicon carbide, silicon nitride, boron nitride and tungsten carbide.

The desired curvature of the closed cylinder bounding side surface 21 is generated by relative movement between the axis of rotation 18 of rotating abrasive means 12 and extruded honeycomb body 16. This relative movement may be carded out by a movement of spindle means 11 in the x and y directions. Movement can be effected, for example, under the control of a programmable computer (not shown) possessing software specific to the product design desired. Thus, it is feasible to produce different shapes (round and non-round) using the contouring set-up disclosed in FIG. 1 above just by changing the software program, i.e. the relative movements between spindle means 11 and extruded honeycomb substrate 16.

In order to specifically demonstrate the effectiveness of this invention the process was utilized to contour "400 cells/in$^2$" (63 cells/cm$^2$) ceramic honeycomb substrates, both round and non-round shapes, particularly for use as diesel particulate filters (earlier-described as DPF's). The following examples are illustrative.

EXAMPLE I

Several fired. 400 cell/in$^2$ (63 cell/cm$^2$) honeycomb pieces possessing an 11" (27.94 cm.) pre-contouring diameter and a 6" (15.24 cm.) length were selected for contouring. For comparison contouring several "green" or unfired pieces were also cut to a 6" (15.24 cm.) length from unfired logs of 11" (27.94 cm.) pre-contouring diameter. In all, eight of the fired pieces and two of the green pieces were contoured to the desired 9" (22.86 cm.) diameter utilizing the inventive process.

The sample pieces, fired and unfired, were clamped with their length along the vertical plane, i.e., the 9" (22.86 cm.) diameter was in the x-y plane, to a Bostomatic 14–40 computerized numerical control (CNC) vertical spindle machine, sold by Boston Digital Corporation, Millford, Mass. This vertical spindle machine possessed a vertical spindle means to which was attached the rotating abrasive means.

The rotating abrasive means used in the preferred embodiment for removing material was a 1" diameter diamond router marketed by the Greenlee Diamond Tool Company in Des Plaines, Ill. The router possessed the following dimensions: a 1" (2.54 cm.) diameter drill rod with 6" (15.24 cm.) of the shank containing diamond plating and 3½" (8.89 cm.) of the shank for clamping in the spindle. It is obvious to one skilled in the art that a cutting tool with larger diameter and a longer length could have been utilized.

The vertical spindle of this machine possessed a three axis (x-y-z) simultaneous control; specifically, 14" (35.56 cm.) of travel in the "Y" direction, 40" (101.6 cm.) of travel in the "X" direction and 16" (40.64 cm.) of travel in the "Z". The pieces were secured to the X-Y table of the rotary spindle machine using two (2) mechanical-type hold down clamps, thus ensuring that the pieces were not able to move in any direction (x-y or z). Pneumatic-type clamps have also been utilized effectively. In this prototype method the vertical rotary spindle machine contoured one half of the piece by rotating the spindle means attached to the rotating abrasive means through a 180° arc while the abrading means contacted the side surface of the honeycomb substrate. The abrasive means was kept in contact with the honeycomb substrate and continuously abraded the substrate along the 180° rotation until the desired 9" diameter dimension was achieved in the first half of the honeycomb substrate. Once half the piece was cut to the desired dimension, the piece was repositioned so that the other side could be abraded to the desired 9" diameter size in the same manner. The honeycomb substrate thus remained completely stationery during each phase of the contouring process while only the only spindle means attached to the diamond contouring router traveled in the x-y plane; the relative movement was controlled by moving only the spindle means attached to the diamond router contouring means in the x-y direction.

All cutting was done at full length of cut (6"/15.24 cm.) so that the full height of the pan was contoured as the abrading diamond router moved around the piece, and thus there was no vertical movement of the spindle means and the attached diamond router. In other words, in the instant embodiment this was accomplished through the use of a abrading means/contouring tool which was at least as long as the piece which was to be contoured, so that no "z", but only an "x & y" movement of the spindle and the attached abrasive means was required. However, it is contemplated that an abrasive means possessing a height dimension less than the dimension of the piece length to be contoured could be utilized if the spindle means to which the abrasive means was attached to was moved vertically in addition to the "x-y" movement during the contouring process.

Feed rates, or linear speed of the router abrading means in the x-y direction, were varied from 6"/min. to 60"/min. (15.24 cm. to 152.4 cm.). The width of cut was varied from 0.050" to 1.000" (0.127 cm. to 2.54 cm.), while the spindle RPMs were varied from 3500 to 5000 RPM (975 to 1400 ft/min./297.18 to 426.72 cm./min.). It is contemplated that higher spindle speeds would allow even higher feed rates, however 5000 RPM was the maximum output of the spindle means on the Bostomatic rotary spindle machine utilized. In all cases where the parameters were varied there was no noticeable differences in cut quality were observed. Finish was somewhat rough, but in all cases well within the acceptable limits for the product.

The contouring process worked equally well for both "fired" and "green" pieces, although there was a slight difference in the dust collection means utilized. The fired ware dust was easier to collect than the fine, powdery dust produced during the contouring of the "green" pieces. Furthermore, the filling of the microscopic valleys of the diamond tool with ceramic residue, i.e., "loading" was virtually non-existent in the fired grinding whereas the green grinding filled the tool with fine powder residue.

Although, the contouring of the substrate as described above was accomplished while the piece to be contoured remained completely stationery, it is contemplated that the best way of contouring would be through an appropriate combination of part rotation and spindle movement relative to the part. As previously described, this combination could be controlled and accomplished through the use of a computer with different software developed for different piece shapes or patterns to be contoured.

EXAMPLE II

In a second application, non-round, oval ceramic honeycomb parts exhibiting a 6" (15.24 cm.) height, a major axis diameter of 8" (20.32 cm.) and a minor axis of 5" (12.7 cm.) were contoured/shaped using a vertical spindle machine commercially marketed as Tri-mac XV by the Pratt and Whitney Company, Hartford, Ct.

In the same manner as was utilized in the round examples' contouring, the vertical spindle machine utilized possessed a three axis (x-y-z) simultaneous control spindle means; 28"

(71.12 cm.) of travel in the "Y" direction, 48' (121.92 cm.) of travel in the "X" direction and 24" (60.96 cm.) of travel in the "Z" direction. The rotating abrasive spindle contouring means utilized to shape the non-round shapes was identical that was used earlier in the 9" (22.86 cm.) diameter round examples, i.e., a 1" (2.54 cm.) diameter diamond router sold by the Greenlee Diamond Tool Company in Des Plaines, Ill. Again, this diamond router possessed 6" (15.24 cm.) of shank length with diamond plating and a 3½" (8.89 cm.) of shank length for clamping in the spindle means. The five "ovals" were all cut at feed rates which ranged 30" to 60"/min. (15.24 cm. to 152.4 cm.), width of cuts which ranged from 0.050" to 1.000" (0.127 cm. to 2.54 cm.), and spindle RPMS which ranged from 3500 to 5000 RPM (975 to 1400 ft/min/297.18 to 426.72 m./min.).

Table I reports the measured perimeter of 5 part examples formed utilizing the inventive contouring/shaping process; it should be noted that the "target", i.e., acceptable perimeter for non-round 8" major×5" minor (20.32 cm.×12.7 cm.) parts was 21.73971" (55.2189 cm.). As can be readily seen the values reported therein indicate that inventive process is highly accurate process for obtaining the desired perimeter size.

TABLE I

| Example | $Perimeter_b$ | $Perimeter_t$ |
|---|---|---|
| 1 | 21.746 | 21.755 |
| 2 | 21.746 | 21.739 |
| 3 | 21.755" | 21.739" |
| 4 | 21.739" | 21.756" |
| 5 | 21.756" | 21.756" |

It should be noted that the diamond tool showed little or no wear and experienced virtually no heat build-up during the contouring of any of the examples, both round and non-round, fired and green, disclosed herein. It is theorized that this is a result of the fact that the material is being fractured away rather than ground; the chip size observed during the actual contouring confirmed this.

A Universal Machining Center marketed under the designation MH 600 C by the MAHO Machine Tool Corp., Naugatuck Ct., has also been successfully used to contour honeycomb ceramic substrates utilizing the inventive process disclosed herein.

It is imperative to note that this process is not limited to diesel particulate filters either fired and green pieces, but may be utilized for any ceramic honeycomb substrate including honeycombs for fluid heating, catalytic treating, and/or fluid filtration applications.

Although the inventive process as is described herein reflects laboratory/experimental, i.e., prototyping, practice only, it will be appreciated that the is capable of being utilized on a commercial scale. In other words, it should be appreciated and apparent from the foregoing description that equivalent substitutions of various mechanisms may be made for those described, as generally indicated in the descriptions of each unit without departing from the scope of the invention. For example, while the rotating-abrasive-means is of the diamond type cutting saw, it should be apparent that other well known abrasive means could be substituted without departing from the scope of the invention defined by the following claims.

I claim:

1. A method for producing a honeycomb body having a side surface bounded by a closed cylinder of a selected circumference and curvature which comprises the steps of:

providing an extruded honeycomb body having a selected length and having a side surface bounded by a closed cylinder of a circumference larger than the selected circumference; and removing material from the side surface to reduce the circumference thereof at least to the selected circumference, wherein the step of removing material comprises abrasively removing material from the side surface with a rotating abrasive means having a length at least equal to the selected length and an axis of rotation parallel to the side surface, the rotating abrasive means being attached to a spindle means which allows the abrasive means to move in a plane perpendicular to the axis of rotation.

2. A method in accordance with claim 1 wherein the curvature of the closed cylinder bounding the side surface is generated by relative movement between the spindle axis of rotation and the extruded honeycomb body, and wherein the relative movement is carried out under the control of a programmable computer.

3. A method in accordance with claim 1 wherein the cylinder cross-section is circular.

4. A method in accordance with claim 1 wherein the cylinder cross section is oval.

5. A method in accordance with claim 1 wherein the rotating abrasive means is comprised of a cylindrical member comprising an abrasive surface coating material selected from the group consisting of diamond, silicon carbide, silicon nitride, boron nitride and tungsten carbide.

* * * * *